United States Patent [19]

Dinter et al.

[11] 4,153,560

[45] May 8, 1979

[54] CORONA DEVICE AND METHOD FOR USING SAME

[75] Inventors: Peter Dinter, Hallgarten; Andreas Kolbe, Wiesbaden, both of Fed. Rep. of Germany

[73] Assignee: Hoechst Aktiengesellschaft, Frankfurt am Main, Fed. Rep. of Germany

[21] Appl. No.: 837,105

[22] Filed: Sep. 28, 1977

[30] Foreign Application Priority Data

Sep. 29, 1976 [DE] Fed. Rep. of Germany ..... 2643772

[51] Int. Cl.[2] ..... B01K 1/00

[52] U.S. Cl. ..... 250/531; 204/164; 204/168

[58] Field of Search ..... 204/164, 165, 168; 250/531, 539, 540

[56] References Cited

U.S. PATENT DOCUMENTS

| | | | |
|---|---|---|---|
| 2,864,756 | 12/1958 | Rothacker | 204/168 |
| 3,183,352 | 5/1965 | Brandt et al. | 204/168 X |
| 3,281,347 | 10/1966 | Winder | 204/168 |
| 3,376,208 | 4/1968 | Wood | 204/168 |
| 3,600,122 | 8/1971 | Coleman | 8/115.7 |
| 4,024,038 | 5/1977 | Luc | 204/168 |

*Primary Examiner*—F. C. Edmundson

*Attorney, Agent, or Firm*—Schwartz, Jeffery, Schwaab, Mack, Blumenthal & Koch

[57] ABSTRACT

A corona discharge device is disclosed in which a cylindrical shell made of a dielectric material is mounted around a rotatable axle. Electrodes are arranged inside and outside of the shell so as to provide a corona discharge across a material to improve its surface qualities. A method of corona discharge treatment with the above apparatus is also disclosed.

25 Claims, 6 Drawing Figures

CORONA DEVICE AND METHOD FOR USING SAME

BACKGROUND OF THE INVENTION

The present invention relates to an improved corona device for modifying the surfaces of materials generally and of thermoplastic films in particular.

In processing films as well as in manufacturing composite films, it is known in the prior art to subject the film surfaces to a corona treatment in order to render them suitable for printing or to increase their bond strengths.

This method involves passing the film to be treated over an electrically grounded support surface, such as a roll, a drum, or an endless belt, and subjecting the film surface which is not in contact with the support surface to a corona produced by supplying high-frequency, high-voltage A. C. to an electrode arranged at a distance from the support surface.

The known methods and devices operating according to this basic principle differ in reality only in the design of the support surface serving as a counter electrode. These surfaces may, for example, comprise a central roll with several electrodes, several support rolls with corresponding electrodes or the like. The dielectric materials used to insulate the counter electrode are, for example: mica, glass, ceramics, plastic films or special qualities of rubber. The electrodes conventionally employed may comprise a plate, wire, comb, knife, half-shell, spring or spindle-shaped electrode. The type of generator used may, for example, be a low-frequency, medium-frequency or high-frequency generator. In addition, methods are known such as those described in German Offenlegungsschrift No. 1,4 04,413, U.S. Pat. No. 2,864,755 and U.S. Pat. No. 2,802,085 in which the above-described conditions have been reversed, i.e., the film is subjected to an electrical corona discharge through an electrode insulated by means of a dielectric material.

The basic systems just described (bare electrode/insulated counter electrode or insultated electrode/bare counter electrode) show general imperfections which are more or less troublesome in practice.

When using a bare electrode and an insulated counter electrode, one drawback, among others, is the relatively high cost resulting from damage to the insulation of the counter-electrode due to punctures, injuries such as cuts or the like or the introduction of moisture into the pretreating station. In such cases, the rolls which are usually insulated by special rubber layers, silicone, etc. must be sent to a rubberizing and vulcanizing plant for repair. As is known from experience, the repair procedure is time-consuming and costly, and the vulcanizing plant is obliged to keep expensive spare parts in stock.

The problems outlined have induced the development of the alternative method in which preferably cylinders or rolls covered with a dielectric material are used as electrodes, as already mentioned. The use of small electrode rolls certainly has some advantages. Apart from a simple design and easier handling when mounting and dismounting, there is also a reduction in the cost of repair achieved by using exchangeable dielectric linings in the form of tube materials which may be fitted or shrunk on, instead of the vulcanizable, permanent insulating layers. As far as the effectiveness of the pre-treatment is concerned, i.e., the surface tension in mN/m obtained on the treated substrate, the first-mentioned method is definitely superior to the alternative method, due to the possibility of combining the counter electrode, necessarily designed as a continuous surface (insulated cylinder), with a point electrode of any shape (wire, comb, threaded pin or knife-shaped electrode, etc.). This is all the more understandable when one considers the preferred electrode shape, namely, a cylindrical roll body of 80 to 100 mm diameter which is thus very far from the sharp-edged electrode profile which is generally regarded as ideal.

German Utility Model No. 74 14 967 would appear to be an attempt to solve the problems mentioned above. It suggests using profiled bare electrode rolls in combination with an insulated counter electrode roll. There are, however, no apparent advantages as compared to a stationary electrode profile (knife, comb-shaped electrode, etc. and, additionally, the desirable principle of the insulated electrode has been abandoned. Consequently, the patented device can only be regarded as a compromise resulting from the necessity of improving a system which is not optimal and the desire to maintain a given concept.

In addition, German Pat. No. 2,044,828 specifies designs for a corona device comprising a roll-like body composed of rods and having electrode wires arranged inside for removing a charge from the underface of a film passed over them, while the upper surface of the film is discharged by electrode wires disposed above the roll body. However, this corona device merely serves to remove charges from films, and it is not adapted for modifying the surfaces with a view toward an improved suitability for printing and/or superior bond strengths.

SUMMARY OF THE INVENTION

In view of the above-discussed prior art, it is an object of the present invention to provide an improved corona device for modifying the surfaces of films which has a directed and high effectiveness.

It is a further object of the invention to provide an apparatus having an improved corona discharge across the material being treated.

It is yet another object of the invention to provide a device which may be easily and inexpensively repaired.

A further object of the invention is to provide a device in which the charged electrodes may be located such that there is a reduced chance of electric shock.

Yet another object of the invention is to provide a device which may be easily and safely cooled.

Finally, it is also an object of the invention to provide an improved method for treating the surface of an article, such as a film of thermoplastic material, by corona discharge.

In accomplishing the foregoing objects, there has been provided in accordance with the present invention a corona device for modifying the surfaces of films comprising:

a. a rotatable roll comprising a cylindrical shell made of a dielectric material;

b. at least one first electrode located outside said roll; and c. at least one second electrode located within said roll, wherein either of said first or second electrodes is adapted for carrying electrical current and the other is adapted to be grounded as a counter electrode.

In a preferred embodiment of the device, the rotatable roll is composed of an axle provided with two or more disks which are mounted at a distance from one another and which carry a cylindrical shell made of a dielectric material. Several electrodes, preferably adjoining the curvature of the cylindrical shell, are disposed inside the roll body and at least one electrode is positioned above the roll body. Current is carried either by the electrode inside the roll body or by the electrode above the roll body, while the respective opposite electrode acts as counter electrode and is grounded.

In another preferred embodiment of the device, the axle is designed as a hollow axle. It is thus possible to introduce a gaseous medium through perforations in the hollow axle, which serves to control the temperature on the surface of the cylindrical shell. In many cases it may, for example, be necessary to cool the shell from the inside by blowing cold air into it.

Although any of the conventional electrodes such as combs, pins, knife-shaped electrodes, or the like may be used, it has proven particularly advantageous in practice to arrange wire electrodes inside the roll and preferably also outside the roll, since this will result in the greatest possible effectiveness.

Depending on the relative arrangement of the electrodes inside and outside of the roll, the corona device may be adjusted to yield particular effects (FIGS. 3*a* to 3*c* and FIG. 4).

A particularly high effectiveness of the corona device is achieved when the electrodes are offset from one another, with preferably two outside electrodes being placed in relation to one inside electrode in staggered position (Fig. 3*c*).

In principle, the cylindrical shell may be made of any dielectric material, however, in practice materials such as glass, paper saturated withn phenolic or melamine resin, fiberglass-reinforced epoxy or silicone resins, polyester resins or polycarbonate resins have proved particularly suitable.

The preferred materials are reinforced polyester or epoxy resin compositions, since they have good dielectric properties combined with high mechanical strengths.

In a preferred embodiment, the disks carrying the cylindrical shell are rotatably mounted on the axle. As a result, it is possible to displace the electrodes with respect to one another and also with respect to the substrate to be treated, and thus to give them a particular directional effect.

Also provided in accordance with the invention is a method for achieving an improved surface treatment of film and sheet materials which comprises the step of applying a corona discharge to the material by means of electrodes placed on both sides of the material and wherein the discharge occurs obliquely across the material between the electrodes on both sides of the material.

Further objects, features and advantages of the invention will become apparent from the detailed description of preferred embodiments which follows.

BRIEF DESCRIPTION OF THE DRAWINGS

Details of the device will be explained by reference to the accompanying drawings, which are referred to merely for purposes of illustration.

In the drawings.

DESCRIPTION OF THE PREFERRED EMBODIMENTS

Figure 1:
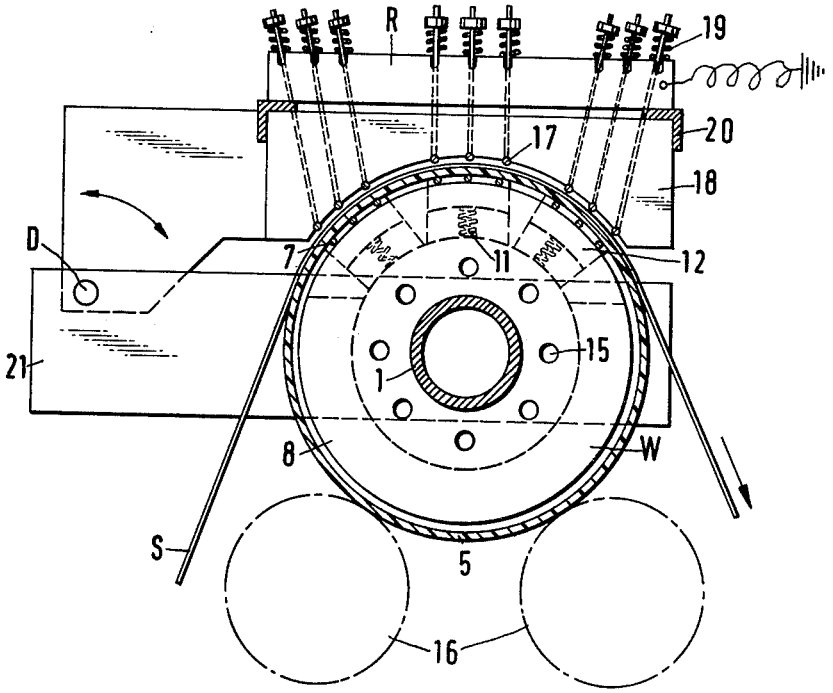
FIG. 1 is a cross-sectional view of the inventive device along the line A—A indicated in FIG. 2, and illustrates the operation of the device.

In the drawings identical parts are indicated by the same reference numerals.

As can be seen from FIG. 1, the corona device according to the invention is fundamentally composed of a cylindrical roll body W which acts as electrode and, at the same time, serves as a support for the substrate S to be treated. A frame R hinged on a pivot D is arranged above the cylindrical roll body W and carries the grounded counter electrodes 17. When the substrate S is passed over the roll W, the surface of the web S which faces away from the rotating roll body is treated by an electrical corona discharge struck between the electrodes 7 disposed inside the roll and the counter electrodes 17 on the outside.

Figure 2:
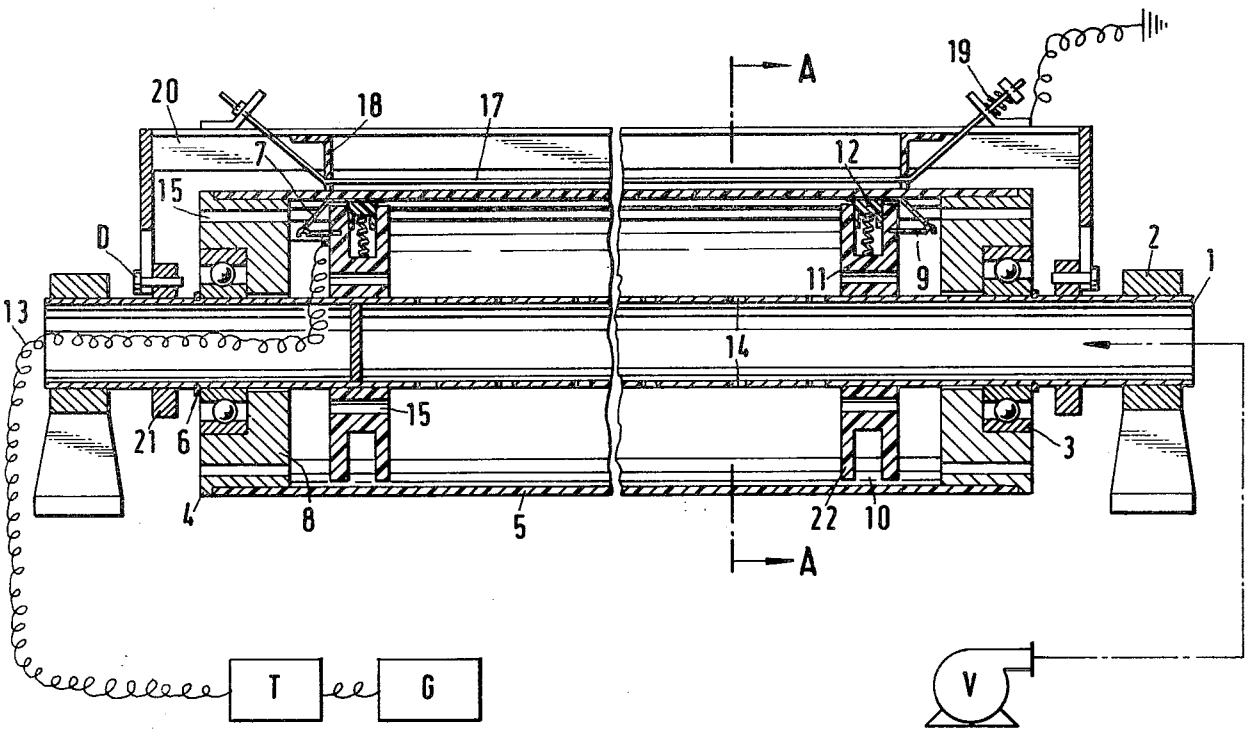
FIG. 2 is a cross-sectional view in axial direction of the inventive device.

FIG. 2 shows a longitudinal cross-section view of the inventive device. The roll comprises a fixed axle 1 (shown as a hollow axle according to the preferred embodiment) supported in bearing brackets 2. Two centering bushings 4 mounted on the axle 1 at a distance from one another are supported in roller bearings 3 so as to be rotatable about the axle 1. The discs 8 are made up of parts 3 and 6 as well as the centering bushings 4. The two discs serve to carry a cylindrical shell 5 made of a dielectric material. The complete roll body thus formed is secured against axial displacement by clamping rings 6. Inside the space enclosed by the centering bushings 4 and the cylindrical shell 5 the actual current carrying electrodes 7 of thin metal wires (preferably of about 0.2 to about 0.3 mm diameter) are suspended on shoulder rings 22 made of an insulating material. The flexible tensioning elements 9 serve to balance thermal expansions and also to avoid sagging of the electrode wires. Since the electrodes 7 must slightly contact the rotating cylindrical shell 5 in order to avoid the formation of an interior corona, they are urged in contact with the inside wall by segmented rings 12 disposed in recesses 10 and forced upwardly by pressure springs 11. By way of a high-tension cable 13 the electrodes are supplied with high-frequency A. C. from a generator G, stepped up in a transformer T. As heat is produced in the course of the pre-treatment process, the temperature of the entire unit is controlled by a gaseous medium which may most simply be air, although any other gas may be used, which is introduced into the hollow axle 1 from the compressor V and enters into the electrode space through the radial distributor bores 14. The gaseous medium escapes from the electrode space through the bores 15 provided in the discs 8 as well as in the centering bushings 4. If necessary, maintenance of the proper temperature of the cylindrical shell 5 may be improved by using the shell in combination with steel rolls of an adjustable or controllable temperature, as indicated in FIG. 1 by the dotted-line rolls 16. This is possible due to the absence of any electrical voltage in the contact area. It is also possible to control the temperature of the device by introducing a liquid, which requires a more expensive design and is achieved by using liquid substances of reduced electrical conductivity, such as distilled water, transformer or silicone oils.

The counter electrode 17 required in the process is arranged above the described roll. Preferably, the counter-electrode also comprises thin metal wires 17, disposed at a distance of 1 to 2 mm from the cylindrical shell 5. The position of the electrodes 17 relative to the roll is fixed by the segmented discs 18 adapted to the radius of the roll body W. The springs 19 produce the necessary pre-tensioning, and they also balance thermal expansions in the longitudinal direction as well as any other sagging. The counter-electrodes are suspended in a frame 20 which may be swung away on the pivot D in order to facilitate introduction of the substrate to be treated. The bearing brackets 21, on the other hand, are tightly fastened to the axle 1.

The device of the invention was developed to take all of the previously set forth requirements into account. Basically, this object has been achieved by a practically ideal shape of electrode and counter-electrode which are designed to form acute points. By drastically reducing the capacity of the electrodes and thus minimizing the corresponding electrical losses, an extremely high energy density is available for the discharge procedure, which cannot even nearly be attained by any of the known roll electrode systems. This advantage will not disappear even if for certain reasons of construction (larger working width, bending of the roll body, etc.) the diameter of the electrode roll must be increased, since the dimensions of the electrodes are in no way related to the rotating body.

Figure 3:
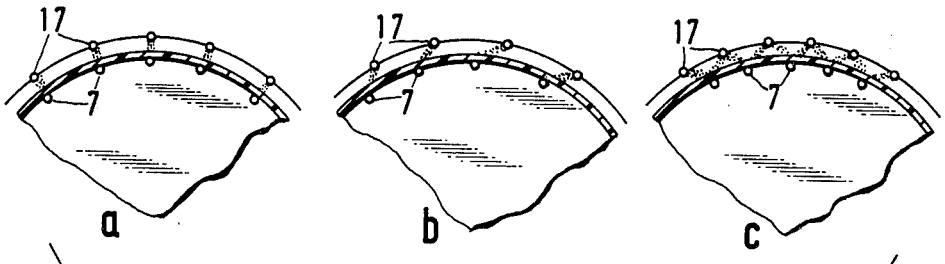
FIGS. 3*a* to 3*c* illustrate different arrangements of electrodes and counter electrodes.

The value of the invention is considerably enhanced by the result which may only be obtained by means of the inventive device. It has been found, surprisingly, that a further increase of the surface tension will result, when the electrode 7 and the counter-electrode 17 are off-set from one another, as diagrammatically shown in FIG. 3*b*. Treatment in an oblique direction, which is more intensive as compared to the treatment according to alternative 3*a*, is further improved when two offset counter-electrodes are placed in relation to one electrode, as shown in FIG. 3*c*.

Figure 4:
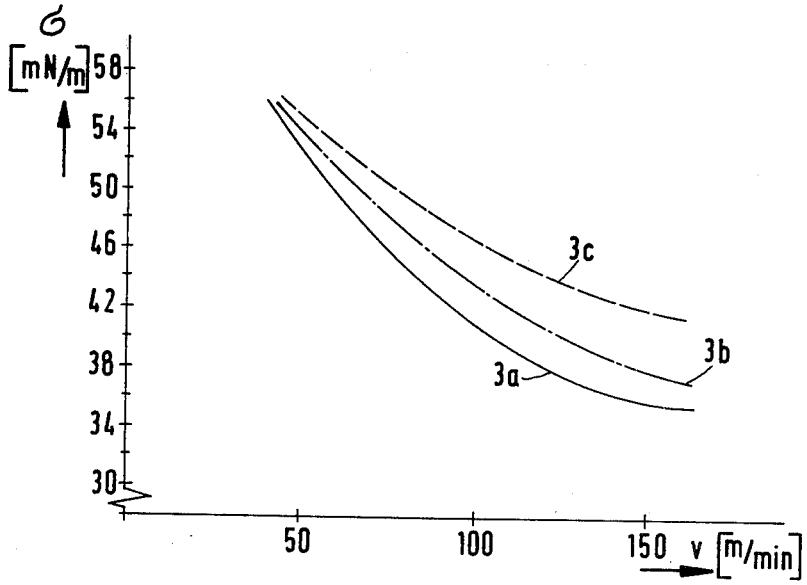
FIG. 4 illustrates the dependence of the surface tension obtained by means of the different electrode arrangements outlined in FIGS. 3*a* to 3*c* upon the speed of travel of a polypropylene flat film substrate.

FIG. 4 illustrates the dependence of the surface tension $\delta$ (mN/m) upon the speed of travel of the substrate to be treated (in this case a polypropylene film, it being understood that the apparatus may be used to treat all other materials normally subjected to a corona discharge) and upon the respective electrode geometry, with the other conditions remaining constant.

A further advantage of the inventive device resides in the fact that it may also be used for pre-treating metal foils. In this case, it would only be necessary to rotate the device by 180° (according to FIG. 1), thus directing the electrodes toward the steel rolls 16 (shown by dotted lines), which would have to be grounded. A metal foil passed over the rolls 16 could then be subjected to a corona discharge.

A similarly unexpected advantage of the invention which has proven extremely valuable, in particular for application in coating and printing machines, is that while in conventional corona devices any moisture introduced into the pre-treating station, e.g., in case of tearing off of the substrate, immediately causes flashovers and thus burning-through of the dielectric, the inventive device is not at all affected by such interferences. Even liquid puddles intentionally produced on the film to be treated do not result in flashovers or interruption of the corona discharge.

Apart from the great number of advantages relating to the procedure as such, the inventive device has additional positive features. One of these is, undoubtedly, the safety of the electrical equipment, obtained by disposing all current carrying parts inside the electrode roll.

In practice, the comparatively simple set-up of the device has proven advantageous. Since the dielectric cylindrical shells used have relatively hard surfaces, as opposed to thin soft rubber layers, a considerable decrease of mechanical damage has also been experienced.

If, in case of machine-changeovers, it should become necessary to replace any parts, this operation could be easily performed by the men in the plant using low-priced spare parts which may be stored in the plant itself.

The apparatus and method of the invention have been disclosed and exemplified in the drawings by certain preferred embodiments. It is to be understood however that the corona discharge device and method of the invention are not limited to only those embodiments, gases and materials disclosed and that the invention covers all equivalents, alternatives and substitutions falling within the scope of the claims.

What is claimed is:

1. A corona discharge device for charging the surface of a material which comprises:

a. a rotatable roll comprising a cylindrical shell made of a dielectric material;

b. at least one first electrode located outside said roll;

c. at least one second electrode located within said roll, said first and second electrodes being arranged along the cylindrical contour of said shell with said second electrodes within said shell being in contact with said shell, and one of said first or second electrodes being adapted for carrying electrical current and the other being adapted to be grounded as a counter electrode; and d. a spring means for pressing said second electrodes within said shell against the inside surface thereof.

2. The corona discharge device as defined by claim 1, wherein said rotatable roll further comprises an axle having discs mounted thereon, arranged in spaced relation to support said cylindrical shell.

3. The corona discharge device as defined by claim 2, wherein said axle is hollow.

4. The corona discharge device as defined by claim 3, wherein said axle is provided with inlet bores leading to the interior of said shell.

5. The corona discharge device as defined by claim 4, wherein said cylindrical shell is comprised of reinforced synthetic resin.

6. The corona discharge device as defined by claim 5, wherein said electrodes within said shell are off-set wtih respect to said electrodes outside said shell such that the corona discharge which results follows an oblique path through the wall of said shell.

7. The corona discharge device as defined by claim 5, wherein said electrodes inside and outside said shell are arranged such that said electrodes inside and outside said shell are offset from one another and further such that said electrodes are arranged such that when one set of electrodes is electrified and the other set is grounded, a discharge flows between two of said electrodes on one side of said shell and one of said electrodes on the other side of said shell.

8. The corona discharge device as defined by claim 1, wherein at least some of said electrodes are wire electrodes and said wire electrodes are arranged approximately parallel to the longitudinal axis of said axle.

9. The corona discharge device as defined by claim 8, wherein all of said electrodes are wire electrodes.

10. The corona discharge device as defined by claim 8, wherein said electrodes within said shell are off-set with respect to said electrodes outside said shell such that the corona discharage which results follows an oblique path through the wall of said shell.

11. The corona discharge device as defined by claim 8, wherein said electrodes inside and outside said shell are arranged such that said electrodes inside and outside said shell are offset from one another and further such that said electrodes are arranged such that when one set of electrodes is electrified and the other set is grounded, a discharge flows between two of said electrodes on one side of said shell and one of said electrodes on the other side of said shell.

12. The corona discharge device as defined by claim 1, wherein said cylindrical shell is comprised of reinforced synthetic resin.

13. The corona discharge device as defined by claim 1, wherein said shell is rotatably mounted around said axle.

14. The corona discharge device as defined by claim 1, wherein said roll is in contact with metal rolls for cooling said roll.

15. A corona discharge device for charging the surface of a material which comprises:

a. a rotatable roll comprising a cylindrical shell made of a dielectric material;

b. at least one metal roll in contact with said cylindrical shell for cooling said roll;

c. at least one first electrode located outside said roll; and d. at least one second electrode located within said roll, one of said first or second electrodes being adapted for carrying electrical current and the other being adapted to be grounded as a counter electrode.

16. The corona discharge device of claim 15, wherein said electrodes outside and inside said shell are arranged along the cylindrical contour of the shell.

17. The corona discharge device of claim 16, wherein said electrodes within said shell are in contact with the inside of said shell.

18. The corona discharge device of claim 17, further comprising a spring means for pressing said electrode within said shell against the inside of said shell.

19. The corona discharge device of claim 15, wherein said rotatable roll further comprises an axle having discs mounted thereon, arranged in spaced relation to support said cylindrical shell.

20. The corona discharge device of claim 19, wherein said axle is hollow.

21. The corona discharge device of claim 20, wherein said axle is provided with inlet bores leading to the interior of said shell.

22. The corona discharge device of claim 15, wherein at least some of said electrodes are wire electrodes and said wire electrodes are wire electrodes and said wire electrodes are arranged approximately parallel to the longitudinal axis of said axle.

23. The corona discharge device of claim 22, wherein said electrodes within said shell are offset with respect to said electrodes outside said shell such that the corona discharge which results follows an oblique path through the wall of said shell.

24. The corona discharge device of claim 22, wherein said electrodes inside and outside said shell are arranged such that said electrodes inside and outside said shell are offset from one another and further such that said electrodes are arranged such that when one set of electrodes is electrified and the other set is grounded, a discharge flows between two of said electrodes on one side of said shell and one of said electrodes on the other side of said shell.

25. The corona discharge device of claim 15, wherein said cylindrical shell is comprised of reinforced synthetic resin.

* * * * *

UNITED STATES PATENT OFFICE

CERTIFICATE OF CORRECTION

Patent No. 4,153,560 Dated May 8, 1979

Inventor(s) Peter DINTER, Andreas KOLBE

It is certified that error appears in the above-identified patent and that said Letters Patent are hereby corrected as shown below:

In Column 3, line 34, kindly delete "withn" and insert instead -- with --.

In Claim 6, line 2, kindly delete "wtih" and insert instead -- with --.

In Claim 10, line 4, kindly delete "discharage" and insert instead -- discharge --.

In Claim 22, lines 21 to 22, kindly delete "are wire electrodes and said wire electrodes".

Signed and Sealed this

*Twenty-fifth* Day of *September 1979*

[SEAL]

*Attest:*

*Attesting Officer*

LUTRELLE F. PARKER

*Acting Commissioner of Patents and Trademarks*